US008666284B2

(12) United States Patent
Kakehi

(10) Patent No.: US 8,666,284 B2
(45) Date of Patent: Mar. 4, 2014

(54) IMAGE FORMING APPARATUS

(75) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 13/308,298

(22) Filed: Nov. 30, 2011

(65) Prior Publication Data

US 2012/0141166 A1 Jun. 7, 2012

(30) Foreign Application Priority Data

Dec. 6, 2010 (JP) ..... 2010-271693

(51) Int. Cl.
*G03G 15/16* (2006.01)

(52) U.S. Cl.
USPC ..... 399/121; 399/165

(58) Field of Classification Search
USPC ..... 399/121, 399
See application file for complete search history.

(56) References Cited

U.S. PATENT DOCUMENTS 6,085,064 A * 7/2000 Nagase et al. ..... 399/399
2010/0215387 A1* 8/2010 Ishikawa ..... 399/45

FOREIGN PATENT DOCUMENTS

JP 5-119636 A 5/1993
JP 9-015987 A 1/1997
JP 9015987 A * 1/1997 ..... G03G 15/00

* cited by examiner

*Primary Examiner* — Clayton E Laballe
*Assistant Examiner* — Jas Sanghera
(74) *Attorney, Agent, or Firm* — Canon USA Inc IP Division

(57) ABSTRACT

An upstream end of a guide surface of a recording material guide in the recording-material conveying direction is located on the same side as a separation belt-stretching roller with respect to an extension of the belt surface from the separation belt-stretching roller to a recessed portion formed in the belt surface by the separation assistance rollers.

6 Claims, 9 Drawing Sheets

IMAGE FORMING APPARATUS

BACKGROUND OF THE INVENTION

1. Field of the Invention

The present invention relates to an image forming apparatus, such as a copier or a laser printer, which transfers a toner image formed on an image bearing member to a recording material using an electrophotography technique. More specifically, the present invention relates to an image forming apparatus having a transfer belt that transfers an image and conveys a recording material.

2. Description of the Related Art

In an electrophotographic apparatus in which a transfer belt stretched over a plurality of rollers carries and conveys a recording material, the recording material on the transfer belt is electrostatically attracted to the transfer belt after having passed through a transfer nip.

However, if the recording material has a low rigidity, the curvature of a separation roller, serving as a separation belt-stretching member, around which the transfer belt is stretched and the rigidity of the recording material itself are not enough to separate the recording material from the transfer belt. In such a case, the recording material is adhered to the transfer belt at a position of the separation roller, resulting in a separation error. Japanese Patent Laid-Open No. 9-015987 discloses a configuration in which uniform protrusions are formed on the surface of the separation roller, around which the transfer belt is stretched, to form unevenness (projecting portions and recessed portions) at the separation position of the transfer belt to separate the recording material. Although unevenness can be formed at the separation position of the transfer belt in this configuration, the transfer belt is constantly and locally subjected to a large tension. As a result, the transfer belt is locally worn away, causing variations in the resistance and making the transfer characteristics unstable.

Japanese Patent Laid-Open No. 5-119636 discloses a method in which a sheet that carries a recording material is deformed to separate the recording material while preventing wearing thereof due to deformation. The method disclosed therein uses rollers, serving as a push-up member, which can be moved between a position where they can push up the transfer sheet from the inside and a position where they do not push up the transfer sheet. In the method disclosed therein, the rollers push up the transfer sheet to separate the recording material, and the rollers do not push up the transfer sheet when the recording material is not separated.

If this configuration is applied to the transfer belt, a push-up member that can locally push up the transfer belt using a roller during a separation process is disposed downstream of a transfer member that transfers a toner image to a recording material on the transfer belt, in the conveying direction of the recording material. If the recording material has a low rigidity, as in the case of using a thin sheet, the transfer belt is locally pushed up and conveys the recording material. Thus, unevenness is formed in the recording material, increasing the rigidity of the recording material during the separation process.

The separated recording material is conveyed along the extension of the belt surface. Accordingly, in one configuration, a guide member for guiding the separated recording material is disposed so as to be flush with the belt surface that is not pushed up. However, when the push-up member pushes up the belt to form unevenness, from a position where the unevenness is formed to the position of the separation belt-stretching member, the recording material is conveyed along the belt surface from the recessed portion to the separation belt-stretching member due to the gravity. After separated, the recording material is conveyed along the extension of the belt surface from the recessed portion to the separation belt-stretching member. The extension of the belt surface from the recessed portion to the separation belt-stretching member is shifted toward the separation belt-stretching member, compared with the belt surface that is not pushed up. In this case, if the guide member for guiding the recording material separated from the belt is disposed so as to be flush with the belt surface that is not pushed up, a conveyance error of the recording material to be conveyed to the guide member may occur when the recording material is separated by a pushing-up operation.

SUMMARY OF THE INVENTION

The present invention can prevent a conveyance error of a recording material to be conveyed to a guide for guiding the recording material after separation, which may occur when a push-up member is used to separate the recording material.

The present invention provides an image forming apparatus including an image bearing member configured to bear a toner image; a movable belt member configured to convey a recording material; a transfer member configured to electrostatically transfer the toner image formed on the image bearing member to the recording material conveyed by the belt member; a push-up member configured to push up, from the inside, the belt member at a position downstream of the transfer member in a recording-material conveying direction by forming local unevenness in a width direction of the belt member; a separation belt-stretching member around which the belt member is stretched, the separation belt-stretching member being disposed downstream of the push-up member in the recording-material conveying direction and configured to separate the recording material; and a recording material guide having a guide surface and disposed downstream of the separation belt-stretching member in the recording-material conveying direction, the recording material guide being configured to guide the recording material separated from the belt member with the guide surface. An upstream end of the guide surface of the recording material guide in the recording-material conveying direction is located on the same side as the separation belt-stretching member with respect to an extension of the belt surface from the separation belt-stretching member to a recessed portion formed in the belt surface by the push-up member.

Further features of the present invention will become apparent from the following description of exemplary embodiments with reference to the attached drawings.

DESCRIPTION OF THE EMBODIMENTS

First Embodiment

Image Forming Apparatus

Figure 1A:
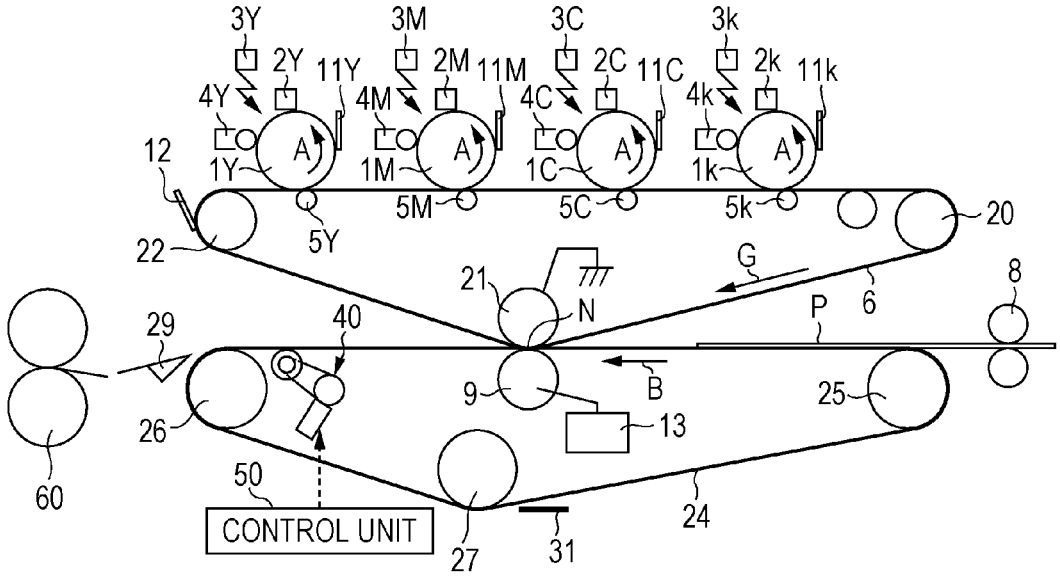
FIGS. 1A and 1B show an image forming apparatus.

Referring to FIG. 1A, the configuration and operation of an image forming apparatus according to this embodiment will be described.

Photosensitive drums 1Y, 1M, 1C, and 1*k* serve as image bearing members and are rotated in the direction of arrow A. Charging units 2Y, 2M, 2C, and 2*k* uniformly charge the surfaces of the image bearing members 1Y, 1M, 1C, and 1*k* at a predetermined voltage. Exposure units 3Y, 3M, 3C, and 3*k* composed of laser beam scanners irradiate the charged surfaces of the photosensitive drums 1Y, 1M, 1C, and 1*k* with light, forming electrostatic latent images thereon. The laser beam scanners are switched on and off according to image information, forming electrostatic latent images corresponding to an image on the photosensitive drums 1Y, 1M, 1C, and 1*k*. Developing units 4Y, 4M, 4C, and 4*k* contain yellow (Y), magenta (M), cyan (C), and black (k) toners, respectively. The electrostatic latent images are developed as they pass through the developing units 4Y, 4M, 4C, and 4*k* that are supplied with a predetermined voltage, and thus, toner images are formed on the surfaces of the photosensitive drums 1Y, 1M, 1C, and 1*k*. In this embodiment, a reversal developing method is employed, in which toner is deposited on exposed portions of the electrostatic latent images and developed.

The toner images formed on the photosensitive drums 1Y, 1M, 1C, and 1*k* are primary transferred to an intermediate transfer belt 6 by corresponding primary transfer rollers 5Y, 5M, 5C, and 5*k*. Thus, four colored toner images are transferred to the intermediate transfer belt 6 in a superimposed manner.

The intermediate transfer belt 6 is stretched around a plurality of belt-stretching rollers 20, 21, and 22, serving as belt-stretching members, so as to be in contact with the surfaces of the photosensitive drums 1Y, 1M, 1C, and 1*k* and is rotated in the direction of arrow G at 250 to 300 mm/sec. In this embodiment, the belt-stretching roller 20 is a tension roller that maintains the tension of the intermediate transfer belt 6 at a constant level. The belt-stretching roller 22 drives the intermediate transfer belt 6.

An endless transfer belt 24 that conveys the recording material held on the outer periphery thereof is stretched around a plurality of belt-stretching rollers 25, 26, and 27, serving as belt-stretching members, and is rotated in the direction of arrow B at 250 to 300 mm/sec. The transfer belt 24 is made of rubber or resin, such as polyimide or polycarbonate, containing carbon black as an antistatic agent. The transfer belt 24 has a volume resistivity of 1E+9 to 1E+14 [Ω·cm] and a thickness of 0.07 to 0.1 [mm]. The transfer belt 24 is made of an elastic member with a Young's modulus measured by a tension test (JIS K 6301) of 0.5 MPa to 10 MPa.

By using an elastic member with a Young's modulus measured by a tension test of 0.5 MPa or more, the shape of the belt 24 can be sufficiently maintained during rotation. By using an elastic member with a Young's modulus of 10 MPa or less, which can undergo sufficient elastic deformation, a separation assistance unit 40 (described below) can effectively create unevenness in the recording material P, making it possible to more effectively separate the recording material P from the transfer belt 24. Furthermore, because a member that can undergo sufficient elastic deformation tends to experience a relaxation phenomenon when the amount of deformation is reduced from the deformed state, wearing of the transfer belt 24 caused by the separation assistance unit 40 can be reduced. The separation belt-stretching roller 26 separates the recording material by bending the transfer belt 24 along its curvature when the separation assistance unit 40 is not used.

Recording materials are stored in a cassette (not shown). When a feed signal is output, a recording material P is conveyed from the cassette by a roller (not shown) and guided to a registration roller pair 8. The registration roller pair 8 temporarily stops the recording material P and then feeds the recording material P to the transfer belt 24 at the same time when toner images on the intermediate transfer belt 6 are conveyed.

Downstream of the registration roller pair 8 in the recording-material conveying direction (the direction of arrow B) is disposed a secondary transfer roller 9 serving as a transfer member, which forms a transfer nip N where the toner images on the transfer belt 24 are transferred to the recording material with respect to the belt-stretching roller 21 facing thereto. When the recording material P is conveyed to the transfer nip N, a secondary transfer voltage having a polarity opposite to that of toner is applied to the secondary transfer roller 9. Thus, the toner images on the intermediate transfer belt 6 are electrostatically transferred to the recording material P. The secondary transfer voltage is controlled at a constant voltage. The value of the constant voltage depends on the current needed for the transfer. Note that the current needed for the secondary transfer varies in the range from about 30 A to 60 A according to the moisture content of the recording material, the environment, the amount of toner to be transferred, and so on.

The secondary transfer roller 9 includes a core metal and an elastic layer composed of an ionic conductive foamed rubber (NBR rubber). The secondary transfer roller 9 has an outside diameter of 24 mm, a surface roughness Rz of from 6.0 to 12.0 (v), and a resistance of from 1E+5 to 1E+7Ω when 2 kV is applied, measured by N/N (23° C., 50% RH) measurement. A secondary-transfer high-voltage power source 13 whose supply bias is variable is connected to the secondary transfer roller 9.

When the recording material P separated from the transfer belt 24 after transfer passes a guide surface of a recording material guide 29 and is conveyed to a fixing unit 60, the toner image is fixed to the recording material P by a heating and pressing process. After the toner image is fixed, the recording material P is discharged from the apparatus.

Configuration of Separation Assistance Unit

Figure 1B:
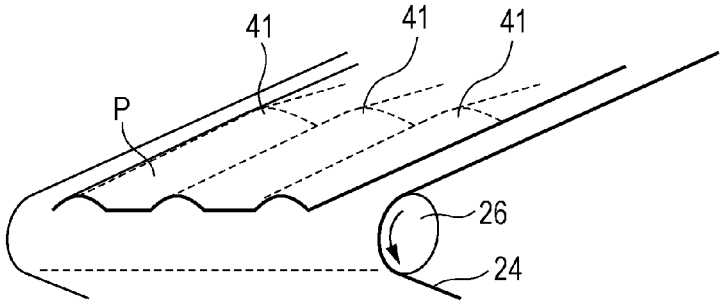

The separation assistance unit 40 pushes up the transfer belt 24 to assist separation of the recording material P from the transfer belt 24. More specifically, the separation assistance unit 40 locally pushes up the transfer belt 24 at a position between the secondary transfer roller 9 and the separation belt-stretching roller 26 to separate the recording material P from the transfer belt 24. When the separation assistance unit 40 pushes up the transfer belt 24, as shown in FIG. 1B, unevenness is locally formed in the transfer belt 24 in the width direction.

As shown in FIG. 1A, the separation assistance unit 40 according to this embodiment is disposed downstream of the secondary transfer portion and upstream of the separation belt-stretching roller 26 in the recording-material conveying direction, inside the transfer belt 24. Downstream of the separation belt-stretching roller 26 is disposed the recording material guide 29 for guiding the separated recording material P to the fixing unit 60 with its guide surface.

Figure 2A:
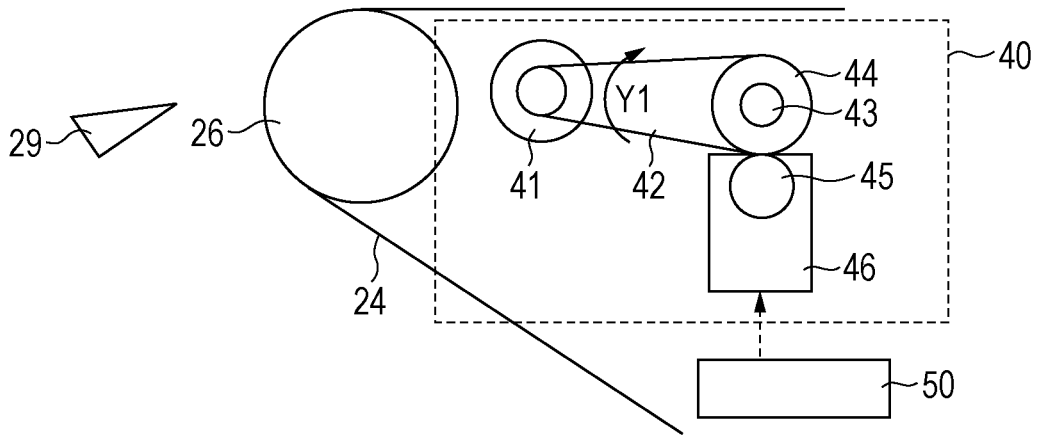
FIGS. 2A and 2B show the operation of a separation assistance unit.
Figure 2B:
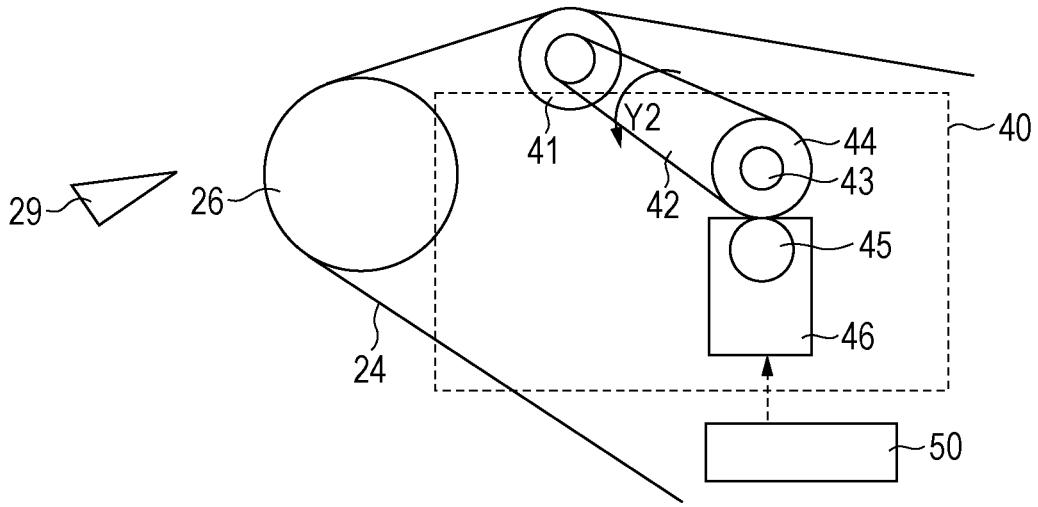

FIGS. 2A and 2B show the detailed configuration and operation of the separation assistance unit 40. The separation assistance unit 40 includes separation assistance rollers 41, serving as separation members, roller frames 42 that support the separation assistance rollers 41 so as to be rotatable, and a roller pivot shaft 43 about which the separation assistance rollers 41 pivot. The separation assistance unit 40 further includes roller driving gears 44 that cause the separation assistance rollers 41 to pivot about the roller pivot shaft 43, motor-driving-force transmission gears 45 that transmit a driving force to the roller driving gears 44, and a motor 46 that generates the driving force. The rotary motion of the motor 46 is transmitted to the roller driving gears 44 via the motor-driving-force transmission gears 45. Because bearings are provided between the roller driving gears 44 and the roller pivot shaft 43, the roller pivot shaft 43 is stationary and is not influenced by the rotary motion of the motor 46.

In FIG. 2A, the separation assistance rollers 41 are not in contact with the transfer belt 24 and are positioned at a retraction position where the separation assistance rollers 41 are away from a push-up position. In FIG. 2B, the separation assistance rollers 41 are in contact with the inner surface of the transfer belt 24 and are positioned at the push-up position where the separation assistance rollers 41 locally push up the transfer belt 24. A predetermined number of forward rotations of the motor 46 causes the separation assistance rollers 41 to pivot about the roller pivot shaft 43 in the direction Y1 from the retraction position shown in FIG. 2A to the push-up position shown in FIG. 2B. Furthermore, a predetermined number of reverse rotations of the motor 46 causes the separation assistance rollers 41 to pivot about the roller pivot shaft 43 in the direction Y2 from the push-up position shown in FIG. 2B to the retraction position shown in FIG. 2A. That is, the forward and reverse rotations of the motor 46 cause the separation assistance rollers 41 to pivot about the roller pivot shaft 43.

The separation assistance rollers 41 are composed of ethylene-propylene rubber (EPDM) and have an outside diameter of from 6 mm to 10 mm and a width of from 5 mm to 15 mm. When the separation assistance rollers 41 push up the transfer belt 24, projecting portions are locally formed in the transfer belt 24 in the width direction. Herein, the width direction means the direction perpendicular to the direction in which the belt surface is moved.

In the state shown in FIG. 2A, the distance between the separation assistance rollers 41 and the separation belt-stretching roller 26 is from 4 mm to 8 mm. In the state shown FIG. 2B, the separation assistance rollers 41 push up the surface of the transfer belt 24 from inside by about 6 mm from the flat state shown in FIG. 2A. The amount by which the separation assistance rollers 41 push up the belt surface is, of course, not limited to 6 mm, and it may be appropriately selected within a range from about 3 mm to 10 mm. Although the separation assistance rollers 41 are separated from the transfer belt 24 in the retraction position shown in FIG. 2A in this embodiment, the separation assistance rollers 41 may be in slight contact with the transfer belt 24 in the retraction position such that the transfer belt 24 is not deformed.

Now, the advantages of using the separation assistance unit 40 to separate the recording material P will be described. Because the secondary transfer roller 9 applies a charge having a polarity opposite to that of toner to the inner surface of the transfer belt 24, the recording material P is attracted to the transfer belt 24 at a position downstream of the transfer nip N. Furthermore, a recording material having a low rigidity, such as a thin sheet, is easily deformed. Therefore, as shown in FIG. 1B, unevenness is also formed in the recording material P due to the local deformation of the transfer belt 24 in the width direction caused by a pushing-up operation. As a result, the geometrical moment of inertia of the recording material P, that is, the rigidity of the recording material P, increases. Accordingly, recording material P having a low rigidity, such as a thin sheet, can be reliably separated.

The number of the separation assistance rollers 41 of the separation assistance unit 40 may be one in the area where the recording material P passes. However, in such a case, the region in the recording material P where unevenness is formed in the width direction becomes narrow. In order to form unevenness in the recording material P in the width direction, it is desirable that a plurality of the separation assistance rollers 41 be provided in the region where the recording material P passes in the width direction.

Figure 3:
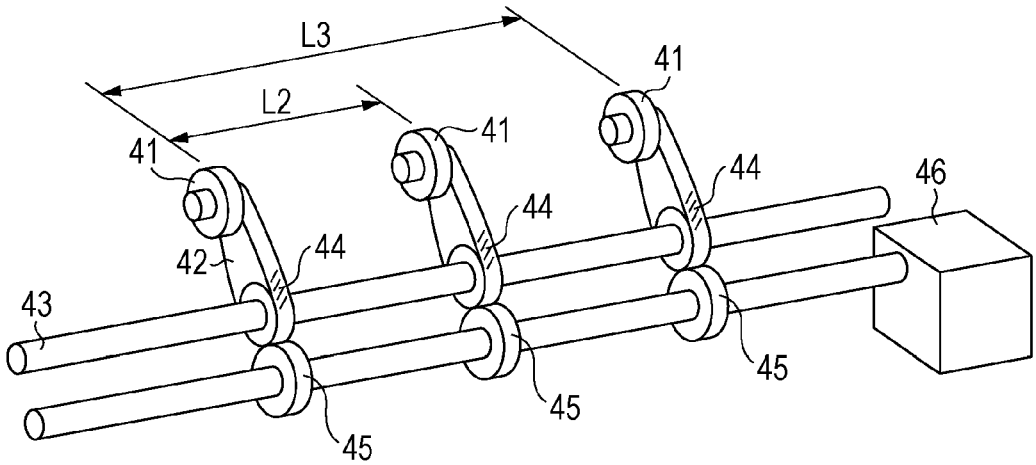
FIG. 3 shows the configuration of the separation assistance unit.

As shown in FIG. 3, three separation assistance rollers 41 are provided in the width direction in this embodiment. The distance L2 between adjacent separation assistance rollers 41 is about 125 mm. The distance L3 between the separation assistance rollers 41 at both ends is about 250 mm. The separation assistance roller 41 in the middle is located at a position substantially corresponding to the center of the recording material P, such that the center of the recording material P of any size is substantially aligned with the common reference line in the width direction. In particular, when an A4-sized thin recording material having a width of 297 mm is conveyed, the A4-sized recording material is pushed up at three positions. Thus, it is effective to increase the separation characteristics of A4-sizes recording materials.

Control of Separation Assistance Unit

Figure 4:
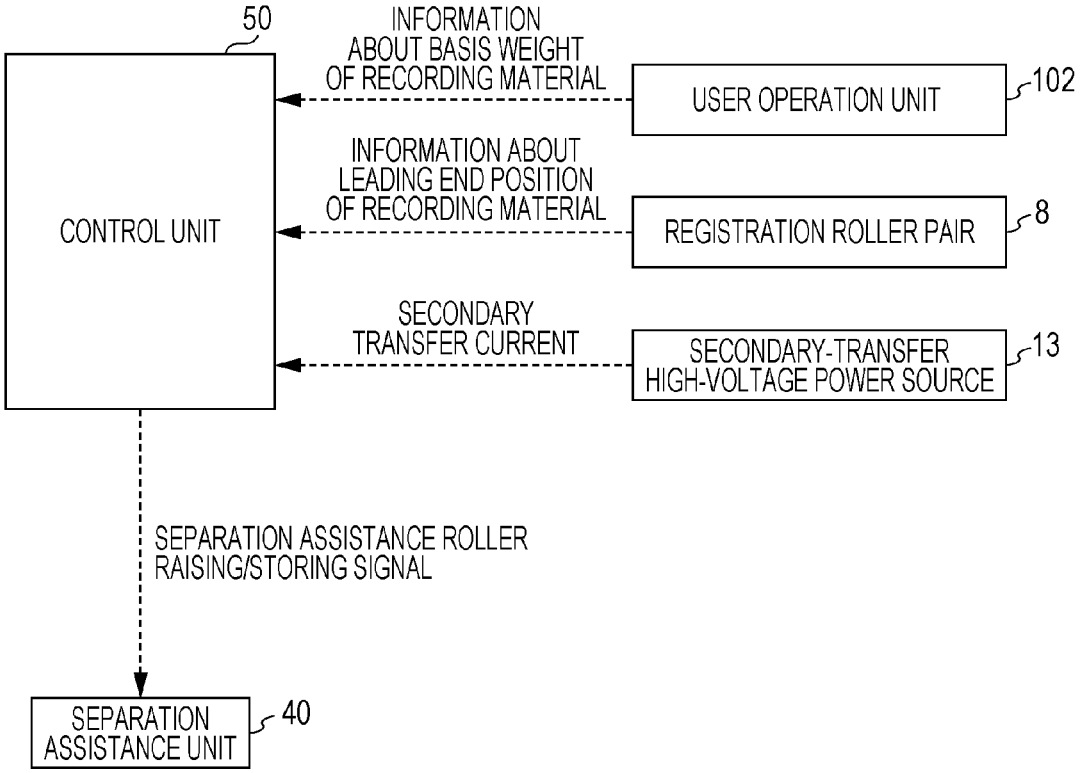
FIG. 4 is a block diagram of a control unit.

The control unit 50 controls the operation position of the separation assistance unit 40. FIG. 4 shows the relationship of the control. An operation position signal for the separation assistance unit 40 is based on the information about the basis weight of the recording material P specified by a user and the information about the leading end position of the recording material P obtained based on the timing of the registration roller pair 8 feeding the recording material P and the conveyance speed of the recording material. The control unit 50 at least includes a central processing unit (CPU), a read-only memory (ROM), and a random-access memory (RAM). Information from a user operation unit 102, i.e., through which the user controls an image forming section, is input to the control unit 50. The timing of moving the registration roller pair 8 is input to the control unit 50. The information about the secondary transfer current from the secondary-transfer high-voltage power source 13 is input to the control unit 50. The control unit 50 controls the operation of the motor of the separation assistance unit 40.

Note that the "basis weight" is a unit indicating the weight per unit area ($g/m^2$) and is commonly used as a value indicating the thickness of a recording material.

In this embodiment, two patterns of separation method are preliminarily stored in the ROM.

In the first pattern, when the recording material has a basis weight of 40 $g/m^2$ or less, the separation assistance rollers 41 are located at the push-up position and form local projecting portions in the transfer belt 24 in the width direction. Thus, the separation of the recording material P from the transfer belt 24 is performed by forming local projecting portions by a pushing-up operation.

In the second pattern, when the recording material has a basis weight greater than 40 $g/m^2$, the separation assistance rollers 41 are located at the retraction position. At the retraction position, the separation assistance rollers 41 are away from the transfer belt 24. Thus, the separation of the recording material P from the transfer belt 24 is performed by utilizing the curvature of the belt-stretching roller 26.

That is, for the recording material P having a specific basis weight (i.e., a first basis weight), the control unit 50 performs an operation mode in which the separation assistance rollers 41 are pushed up. For the recording material P having a second basis weight that is larger than the first basis weight, the control unit 50 does not push up the separation assistance rollers 41 but performs another operation mode in which the recording material P is separated by the belt-stretching roller 26.

The basis weight of the recording material P is input by the user through the user operation unit 102 or input to a recording material container. Based on the basis weight information input to the image forming apparatus, the control unit 50 determines the movement of the separation assistance unit 40.

Figure 5:
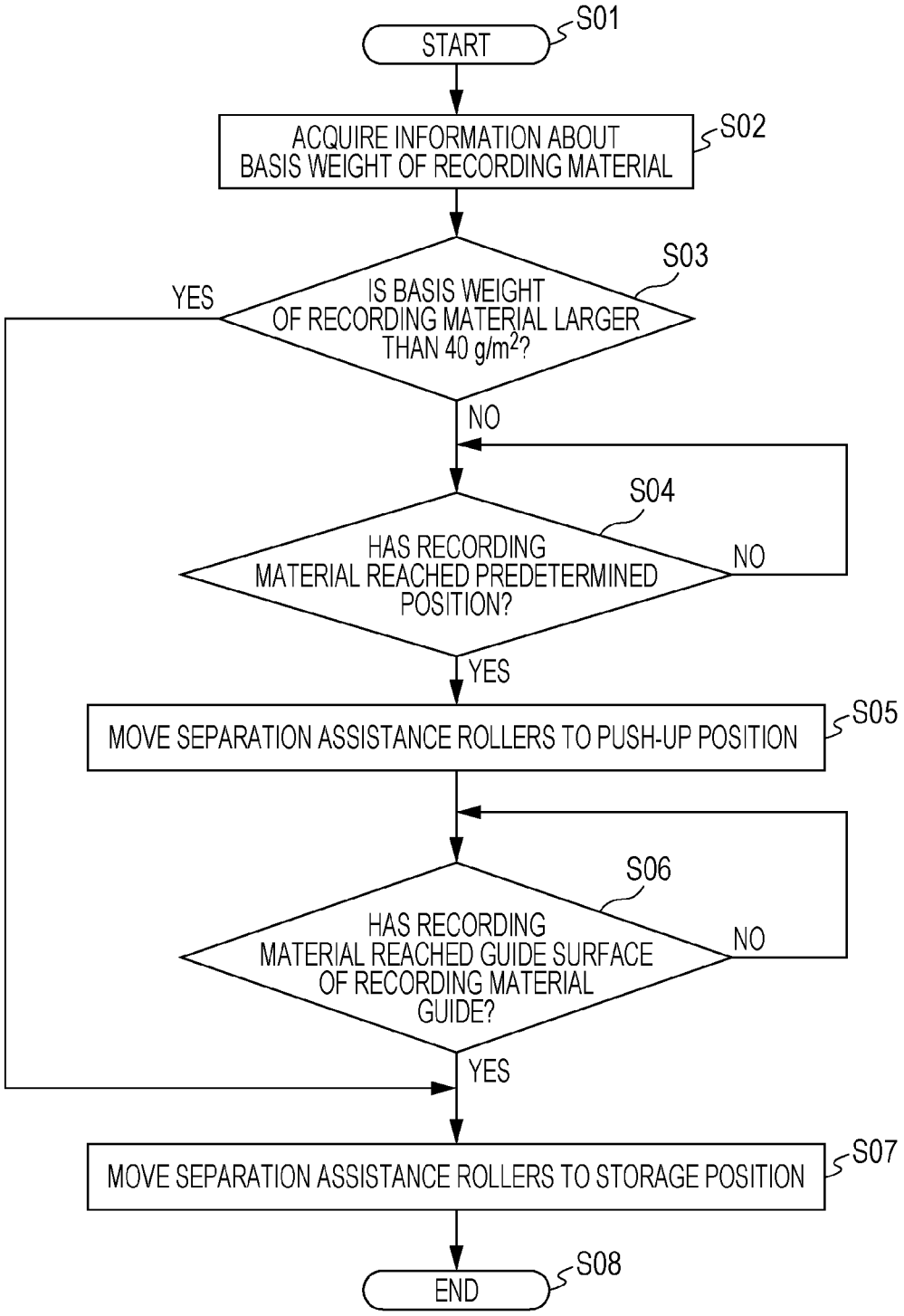
FIG. 5 is a flowchart of the operation of the separation assistance unit.

Referring to FIG. 5, a flowchart of the operation control of the separation assistance unit 40 will be described. When the process is started (step S01), the information about the basis weight of the recording material P set by a user through the user operation unit 102 is acquired (step S02). Then, whether or not the basis weight is larger than 40 g/m$^2$ is determined (step S03). If it is determined that the basis weight of the recording material P is larger than 40 g/m$^2$ in step S03, the separation assistance rollers 41 are located at a storage position (step S07). If the basis weight of the recording material P set by the user is 40 g/m$^2$ or less, in order to separate the recording material P having a low rigidity from the transfer belt 24, the operation of pushing up the transfer belt 24 by the separation assistance rollers 41 is necessary to form local projecting portions. If the basis weight of the recording material P set by the user is 40 g/m$^2$ or less, whether or not the recording material P has reached a predetermined position is determined (step S04). The predetermined position is defined such that it is located upstream of the separation assistance rollers 41 in the recording-material conveying direction and such that the operation of pushing up the transfer belt 24 by the separation assistance rollers 41 is completed before the leading end of the recording material P has reached the portion pushed up by the separation assistance rollers 41. The position of the recording material P is determined by detecting the position of the recording material P based on the elapsed time since the recording material P passed the registration roller pair 8 and the conveyance speed of the recording material P, or by detecting the position of the recording material P using a detector that detects passing of the recording material P. If it is determined that the recording material P has reached the predetermined position, the separation assistance rollers 41 are moved in the direction Y1 and located at the push-up position where they push up the transfer belt 24 (step S05). When positioned on the transfer belt 24 deformed by the separation assistance rollers 41, the recording material P is made uneven and increased in rigidity. Thus, the recording material P is separated from the transfer belt 24 before reaching the area where the transfer belt 24 is in contact with the belt-stretching roller 26. Next, whether or not the leading end of the recording material P has reached the guide surface of the recording material guide 29 is determined (step S06). Note that the position of the recording material P is determined by detecting the position of the recording material P based on the elapsed time since the recording material P passed the registration roller pair 8 and the conveyance speed of the recording material, or by detecting the position of the recording material P using a detector that detects passing of the recording material P. If it is determined that the recording material P has reached the guide surface of the recording material guide 29, the recording material P is assumed to have been separated from the transfer belt 24. Then, the separation assistance rollers 41 are moved to the storage position (step S07), and the process is completed (step S08).

Although the control is performed according to the basis weight information input by the user in this embodiment, the basis weight of the recording material P may be determined by a sensor provided in the image forming apparatus. When the operation of the separation assistance unit 40 is controlled according to the basis weight detected by the sensor, even when recording materials having a low basis weight are stored in a cassette for recording materials having a high basis weight, the push-up operation is performed. Therefore, even if recording materials having a low basis weight are stored in a wrong position, separation error of such recording materials can be prevented.

Examples of the sensor include a weight sensor that detects the weight of the conveyed recording material P. By providing the weight sensor in the conveying path of the recording material, the basis weight of the recording material P can be determined according to the weight detected by the weight sensor and the size information (area) of the recording material P. Alternatively, a transmissive sensor that detects the transmittance of light may be provided in the conveying path of the recording material P to determine the thickness of the recording material P according to the transmittance of light passing through the conveyed recording material P.

Position of Recording Material Guide

In this embodiment, the recording material guide 29 for guiding the recording material P separated from the transfer belt 24 is provided. The recording material guide 29 is disposed downstream of the separation belt-stretching roller 26 in the recording-material conveying direction.

Figure 6:
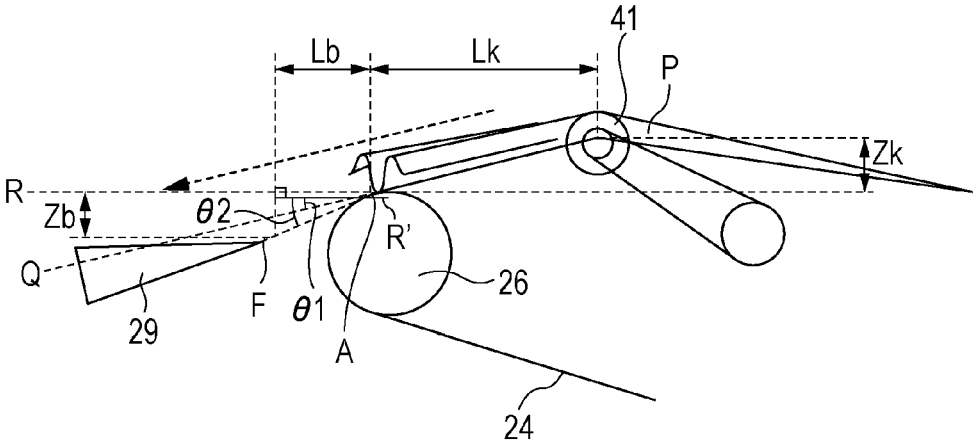
FIG. 6 shows the position of a recording material guide.

Referring to FIG. 6, the positional relationship between the recording material guide 29 and the transfer belt 24 will be described. FIG. 6 shows the transfer belt 24 when the separation assistance rollers 41 are used to separate the recording material P. When the separation assistance rollers 41 push up the transfer belt 24, a projecting portion (a first projecting portion), another projecting portion (a second projecting portion) adjacent to the first projecting portion, and a recessed portion, which is the lowest portion between the first and second projecting portions in the width direction, are locally formed in the transfer belt 24 in the width direction. In this embodiment, the first projecting portion and the second projecting portion have the same height. Therefore, the recessed portion is located at the midpoint between the first projecting portion and the second projecting portion. Dashed line Q is an extension of the surface of the transfer belt 24 from the recessed portion to the separation belt-stretching roller 26, extended to the downstream side in the recording-material conveying direction. Dashed line R is an extension of the surface of the transfer belt 24, which is not pushed up, from the secondary transfer portion to the separation belt-stretching roller 26, extended to the downstream side in the recording-material conveying direction. Intersecting point A shows a contact point where dashed line Q is in contact with the separation belt-stretching roller 26, and solid line R' is a line passing through intersecting point A and parallel to dashed line R. The angle formed between dashed line Q and solid line R' is denoted by θ1, and the angle formed between solid line R' and a line connecting intersecting point A and the upstream end, F, of the recording material guide 29 in the recording-material conveying direction is denoted by θ2. In this embodiment, the upstream end F of the recording material guide 29 is located on the same side as the separation belt-stretching roller 26 with respect to dashed line Q. Thus, θ2 is larger than θ1.

The reason for this will be described. When the separation assistance rollers 41 push up the transfer belt 24 to form unevenness, the recording material P does not protrude at the position where unevenness is formed. The recording material P is, from the unevenness formed in the transfer belt 24 to the separation belt-stretching roller 26, is conveyed along the belt surface from the recessed portion to the separation belt-stretching roller 26. This is because the recording material P is subjected to gravity. After separated, the recording material P is conveyed along the extension of the belt surface (dashed line Q) from the recessed portion to the separation belt-stretching member 26. Because the locus of the recording material P after separation may be slightly shifted above or below dashed line Q, it is desirable that the upstream end F of the recording material guide 29 in the recording-material conveying direction be disposed at a position away from dashed line Q and on the same side as the separation belt-stretching roller 26.

The extension of the belt surface (dashed line Q) from the recessed portion to the separation belt-stretching member 26 is shifted toward the separation belt-stretching member 26 side compared with the extension of the belt surface (dashed line R) that is not pushed up. In this case, if the recording material guide 29 for guiding the recording material P separated from the transfer belt 24 is disposed so as to be flush with the belt surface that is not pushed up, a conveyance error of the recording material P to be conveyed to the recording material guide 29 may occur when the recording material P is separated by a pushing-up operation.

Reference numeral Lk denotes the distance between the recessed portion and intersecting point A in the recording-material conveying direction. Herein, the position of the recessed portion in the recording-material conveying direction is the central position, in the conveying direction, of the region over which the transfer belt 24 is in contact with the separation assistance rollers 41 when pushed up by the separation assistance rollers 41. Reference numeral Zk denotes the height of the recessed portion. Herein, the height of the recessed portion means the dimension of the recessed portion in the direction perpendicular to the flat, i.e., not pushed up, surface of the transfer belt 24 from the secondary transfer portion to the separation belt-stretching roller 26. Reference numeral Lb denotes the distance between the point A and the upstream end F of the recording material guide 29 in the recording-material conveying direction. Reference numeral Zb denotes the distance between dashed line R and the upstream end F of the recording material guide 29 in the direction perpendicular to dashed line R.

In this embodiment, Lk=15 mm, Zk=4 mm, and θ1=15°. Furthermore, Lb=8.7 mm, Zb=4.7 mm, and θ2=28°. Because θ2>θ1, the upstream end F of the recording material guide 29 in the recording-material conveying direction is located on the same side as the separation belt-stretching roller 26 with respect to dashed line Q. Of course, Lk, Zk, Lb, and Zb are not limited to the above values, as long as the upstream end F of the recording material guide 29 in the recording-material conveying direction is located on the same side as the separation belt-stretching roller 26 with respect to dashed line Q.

Note that the height, Zk, of the recessed portion increases as the height of the projecting portion increases. When the height of the projecting portion is in the range from about 3 mm to 10 mm, the height of the recessed portion is in the range from about 0 mm to 8 mm.

Figure 7A:
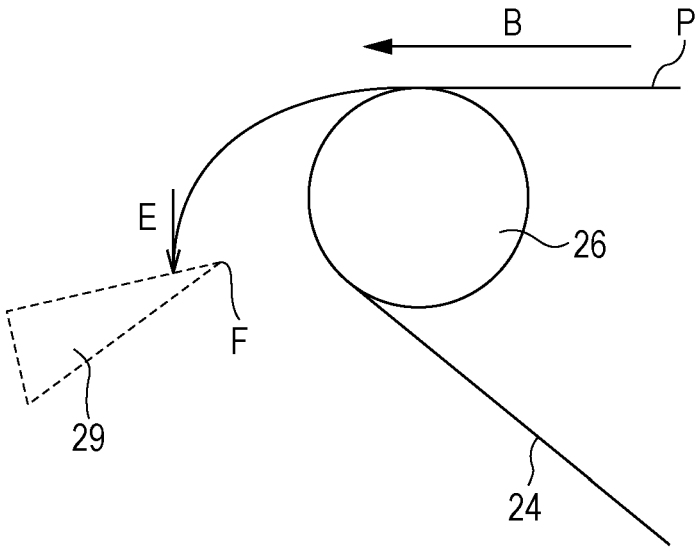
FIGS. 7A and 7B show bending of a recording material after separation.
Figure 7B:
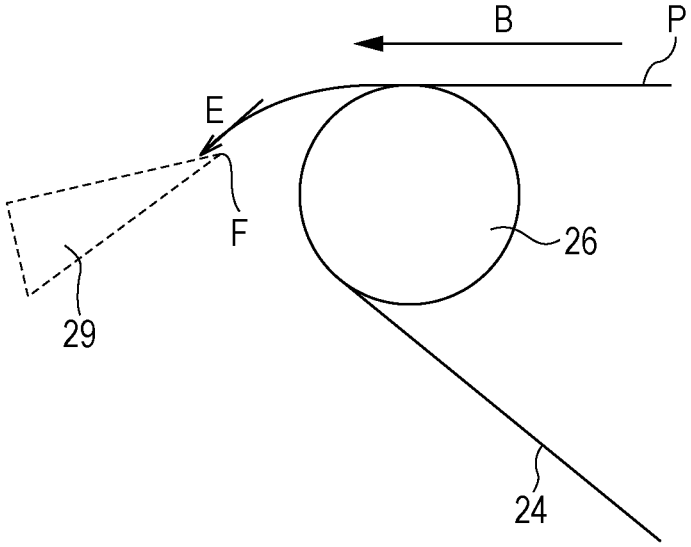

During a period of time since the leading end of the recording material P is separated from the transfer belt 24 until it reaches the recording material guide 29, the recording material P is subjected to gravity in the vertical direction. When the recording material P has a relatively low basis weight, i.e., a basis weight in the range from 40 g/m$^2$ to 60 g/m$^2$, the leading end of the recording material P is gradually bent. However, if, as shown in FIG. 6, the recording material guide 29 is located on the same side as the separation belt-stretching roller 26 with respect to dashed line Q, the distance between the surface of the transfer belt 24 that is not pushed up and the recording material guide 29 is large. As a result, when the leading end of the recording material P is separated without the transfer belt 24 being pushed up, the leading end of the recording material P may be directed vertically downward when the leading end of the recording material P after separation reaches the recording material guide 29. As a result, as shown in FIG. 7A, the angle formed between the direction of the leading end of the recording material P (arrow E) and the conveying direction of the recording material (arrow B) may become 90° or more, rolling the leading end of the recording material P on the recording material guide 29 and causing a conveyance error. Accordingly, it is desirable that the distance between the extension of the transfer belt 24 that is not pushed up (dashed line R) and the recording material guide 29 be set equal to or smaller than a predetermined value, so that the leading end of the recording material P can reach the recording material guide 29 before the recording material P is bent and the leading end thereof (arrow E) is directed vertically downward, as shown in FIG. 7B.

Figure 8:
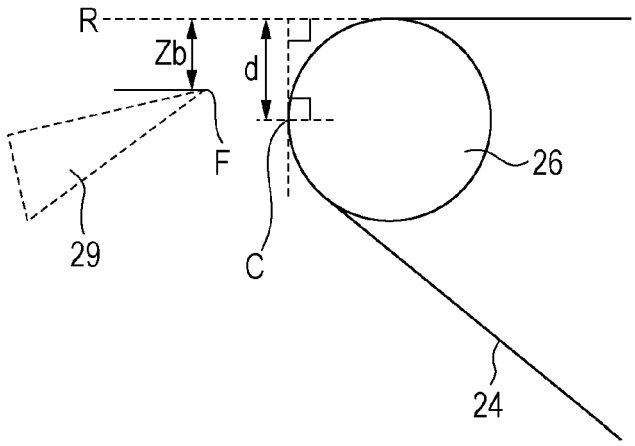
FIG. 8 shows the positional relationship between the recording material guide and a separation belt-stretching member.

Thus, in this embodiment, the position of the recording material guide 29 in the vertical direction is set as shown in FIG. 8. Reference numeral C denotes the position where the angle formed between the tangent line of the surface of the transfer belt 24 and dashed line R are perpendicular to each other, or the position in the transfer belt 24 where the tangent line of the belt surface extends in the vertical direction. Reference numeral d denotes the distance between dashed line R and point C in the vertical direction. Reference numeral Zb denotes the distance between dashed line R and the upstream end F of the recording material guide 29 in the vertical direction. In this embodiment, Zb≤d. That is, the upstream end F of the guide surface of the recording material guide 29 is located above the position where the belt surface is directed vertically downward along the curvature of the separation belt-stretching roller 26 in the vertical direction. The reason for this will be described. The leading end of the recording material P immediately after separation is bent due to gravity. The smaller the basis weight of the recording material P, the larger the curvature, i.e., the extent of bending, of the bent portion of the recording material P, approaching the curvature of the belt surface. In this embodiment, the recording material P is separated without pushing up the transfer belt 24 when the basis weight is larger than 40 g/m$^2$. Therefore, when the recording material P has a relatively low basis weight, more specifically, from about 40 g/m$^2$ to 50 g/m$^2$, the curvature of the recording material P approaches that of the belt surface. However, it is assumed that the curvature of the bent portion of the recording material P separated from the belt, even if it has a relatively low basis weight, does not exceed the curvature of the belt surface. Accordingly, in this embodiment, the position of the upstream end F of the recording material guide may be set above the position where the tangent line of the bent belt surface is perpendicular to dashed line R in the vertical direction. As a result, even with the recording material P having a relatively low basis weight, the leading end of the recording material P reaches the recording material guide 29 before it is directed vertically downward, or in the direction perpendicular to dashed line R.

Note that, in this embodiment, the position of point C in the vertical direction agrees with the center of rotation of the separation belt-stretching roller 26. That is, the upstream end F of the recording material guide 29 is disposed above the center of rotation of the separation belt-stretching roller 26 in the vertical direction. Because the radius, r, of the separation belt-stretching roller 26 is about 8 mm, the distance, d, between dashed line R and point C in the vertical direction is about 8 mm. Because the distance Zb is about 4.7 mm, Zb≤d is met. Of course, the above values are not intended to be limiting, and the values may be set such that Zb≤d is met.

The upper limit of θ2 is determined from Zb=d. That is, because θ2=arctan (Zb/Lb)≤arctan (d/Lb), the upper limit of θ2 is set arctan (d/Lb). More specifically, in this embodiment, arctan (d/Lb)=arctan (8/8.7)=43°. Thus, the upper limit of θ2 is set to about 43°.

Furthermore, in this embodiment, a part of the guide surface of the recording material guide 29 and the downstream end in the recording-material conveying direction are located on the opposite side of the separation belt-stretching roller 26 with respect to dashed line Q. This is because, if the entire guide surface of the recording material guide 29 is located on the same side as the separation belt-stretching roller 26 with respect to dashed line Q, the recording material P after separation may fail to come into contact with the guide surface of the recording material guide 29. Of course, the present invention is not limited to this embodiment, and the downstream end of the guide surface of the recording material guide 29 may be located on the same side as the separation belt-stretching roller 26 with respect to dashed line Q.

Although the intermediate transfer belt 6 is used as the image bearing member in this embodiment, the configuration is not limited thereto. A configuration in which toner images are directly transferred from the photosensitive drums, serving as the image bearing members, to the recording material P held on the transfer belt 24 is also possible.

Although the amount by which the separation assistance rollers 41 push up the transfer belt 24 is constant in this embodiment, the amount of push-up may be changed depending on the basis weight. In such a configuration, the position of the recording material guide 29 may be selected with reference to the extension of the surface of the transfer belt 24 from the recessed portion to the separation belt-stretching member 26 when the amount of push-up is the largest. By doing so, with whatever amount of push-up, the recording material guide 29 is always located on the same side as the separation belt-stretching roller 26 with respect to the extension extended to the downstream side of the surface of the transfer belt 24 from the recessed portion in the transfer belt 24 to the separation belt-stretching roller 26.

In this embodiment, dashed line Q, which is the extension of the belt surface from the recessed portion in the transfer belt 24 to the separation belt-stretching member 26, is used to determine the position of the recording material guide 29. However, in some cases, the belt surface from the recessed portion in the transfer belt 24 to the separation belt-stretching member 26 is not linear. In such cases, instead of dashed line Q, a common tangent line in contact with both the recessed portion in the transfer belt 24 and the separation belt-stretching roller 26 from the outer periphery of the transfer belt 24 may be used to determine the position of the recording material guide 29. When the common tangent line is used to determine the position of the recording material guide 29, the upstream end, in the recording-material conveying direction, of the recording material guide 29 may be located on the same side as the separation belt-stretching roller 26 with respect to the common tangent line in contact with both the recessed portion in the transfer belt 24 and the separation belt-stretching roller 26 from the outer periphery of the transfer belt 24. This configuration prevents a conveyance error of the recording material P to be conveyed to the guide for guiding the separated recording material P, which may occur when the recording material P is separated by using the push-up member. The position of the downstream end, in the recording-material conveying direction, of the recording material guide 29 may be determined with reference to the common tangent line. That is, the downstream end, in the recording-material conveying direction, of the recording material guide 29 may be located on the opposite side of the separation belt-stretching roller 26 with respect to the common tangent line in contact with both the recessed portion in the transfer belt 24 and the separation belt-stretching roller 26 from the outer periphery of the transfer belt 24. This configuration prevents a problem of the separated recording material P failing to come into contact with the guide surface of the recording material guide 29. The downstream end of the guide surface of the recording material guide 29 may of course be located on the same side as the separation belt-stretching roller 26 with respect to the common tangent line.

Second Embodiment

The description of the configuration common to the first embodiment will be omitted. The position of the recording material guide 29 is fixed in the first embodiment, whereas the tip of the recording material guide 29 is movable in this embodiment.

Figure 9:
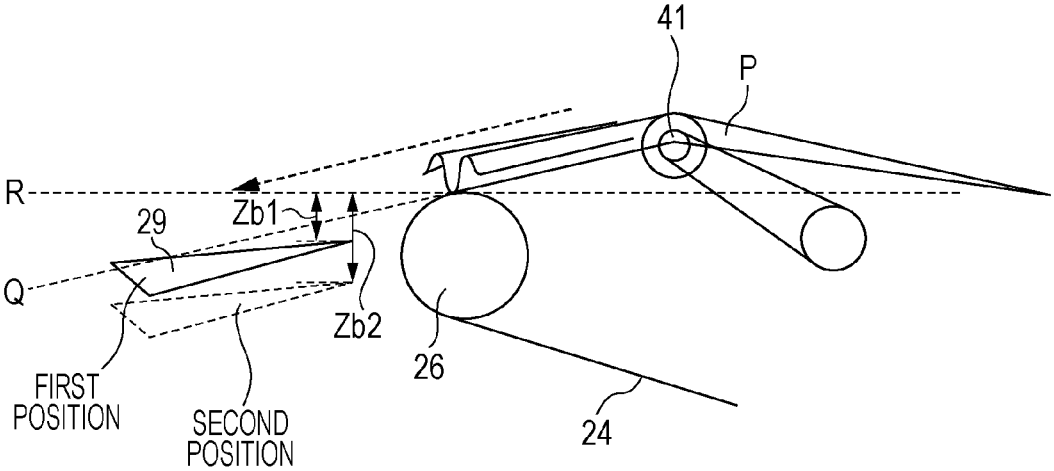
FIG. 9 shows the operation of a recording material guide according to a second embodiment of the present invention.

In this embodiment, the tip of the recording material guide 29 receives a driving force from a motor (not shown) and moves to a first position shown in FIG. 9 and to a second position below the first position in the perpendicular direction that is perpendicular to the surface of the transfer belt 24 not pushed up.

Reference numeral Zb1 denotes the distance between the upstream end, in the recording-material conveying direction, of the recording material guide 29 at the first position and the extension of the surface of the transfer belt 24 that is not pushed up. Herein, Zb1=4.6 mm, and, at the first position, the upstream end of the recording material guide 29 is on the same side as the separation belt-stretching roller 26 with respect to dashed line Q, and the downstream end thereof is on the opposite side of the separation belt-stretching roller 26 with respect to dashed line Q.

Reference numeral Zb2 denotes the distance between the upstream end, in the recording-material conveying direction, of the recording material guide 29 at the second position and the extension of the surface of the transfer belt 24 that is not pushed up. Herein, Zb2=6.5 mm, and, at the second position, the downstream end of the recording material guide 29, as well as the upstream end thereof, is on the same side as the separation belt-stretching roller 26 with respect to dashed line Q.

Figure 10:
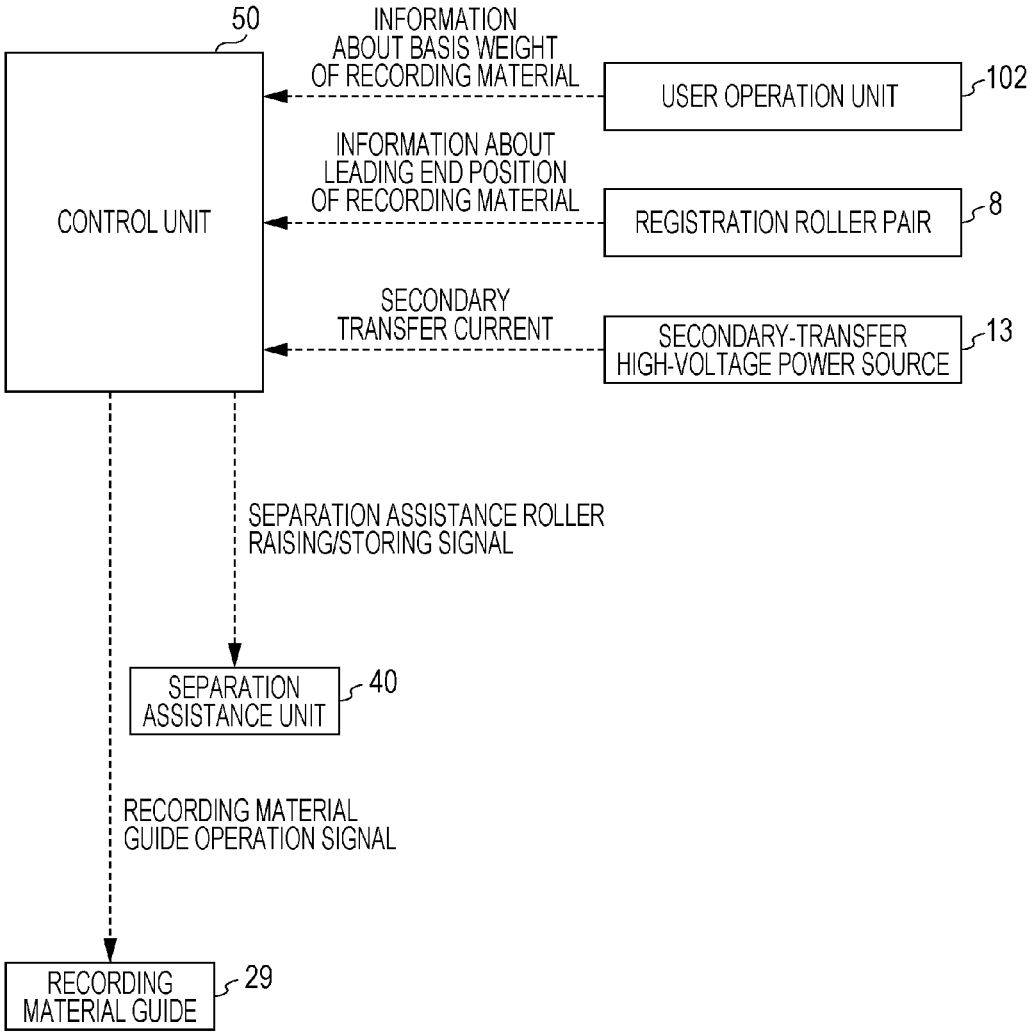
FIG. 10 is a block diagram of a control unit according to the second embodiment of the present invention.

As shown in FIG. 10, in this embodiment, the operation of the recording material guide 29 is controlled by the control unit 50. The control unit 50 sends a recording-material-guide operating signal to the recording material guide 29 to control the operation of the recording material guide 29. In the control unit 50, two patterns of the operation of the recording material guide 29 are stored in the ROM in advance.

In the first pattern, when the separation assistance rollers 41 are located at the retraction position and, thus, the recording material P is separated from the transfer belt 24 utilizing the curvature of the separation belt-stretching roller 26, the recording material guide 29 is located at the first position.

In the second pattern, when the separation assistance rollers 41 are located at the push-up position to form local projecting portions in the transfer belt 24 in the width direction and, thus, the recording material P is separated by a pushing-up operation, the recording material guide 29 is located at the second position below the first position.

In this embodiment, the recording material guide 29 is disposed at a lower position when the separation assistance rollers 41 are used to push up the transfer belt 24. As a result, even when the height of the recessed portion formed in the transfer belt 24 is high, the recording material guide 29 is always located on the same side as the separation belt-stretching roller 26 with respect to the extension of the surface of the transfer belt 24 from the recessed portion to the separation belt-stretching roller 26 extended to the downstream side.

In this embodiment, the upstream end of the recording material guide 29 when the recording material P is separated without the separation assistance rollers 41 is located on the same side as the separation belt-stretching roller 26 with respect to dashed line Q. Of course, the configuration is not limited to this, and the upstream end of the recording material guide 29 when the recording material P is separated without the separation assistance rollers 41 may be located on the opposite side of the separation belt-stretching roller 26 with respect to dashed line Q. In this embodiment, dashed line Q, which is the extension of the belt surface from the recessed portion in the transfer belt 24 to the separation belt-stretching member 26, is used to determine the position of the recording material guide 29. However, in some cases, the belt surface from the recessed portion in the transfer belt 24 to the separation belt-stretching member 26 is not linear. In such cases, instead of dashed line Q, a common tangent line in contact with both the recessed portion in the transfer belt 24 and the separation belt-stretching roller 26 from the outer periphery of the transfer belt 24 may be used to determine the position of the recording material guide 29.

By doing so, at the second position, the downstream end, in the recording-material conveying direction, of the recording material guide 29, as well as the upstream end thereof, is located on the same side as the separation belt-stretching roller 26 with respect to the extension of the common tangent line in contact with both the recessed portion in the transfer belt 24 and the separation belt-stretching roller 26 from the outer periphery of the transfer belt 24. As a result, it is possible to prevent a conveyance error of the recording material P to be conveyed to the guide for guiding the separated recording material P, even if the recording material P is separated by using the push-up member. Furthermore, at the first position, the upstream end of the recording material guide 29 is located on the same side as the separation belt-stretching roller 26 with respect to the extension of the common tangent line, and the downstream end of the recording material guide 29 is located on the opposite side of the separation belt-stretching roller 26 with respect to the common tangent line. Of course, at the second position, the upstream end of the recording material guide 29 may be located on the opposite side of the separation belt-stretching roller 26 with respect to the common tangent line.

The present invention is not limited to the above-described embodiments, and it may be variously modified within the spirit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-271693 filed Dec. 6, 2010, which is hereby incorporated by reference herein in its entirety.

What is claimed is:

1. An image forming apparatus comprising:

an image bearing member configured to bear a toner image;

a movable belt member configured to convey a recording material;

a transfer member configured to electrostatically transfer the toner image formed on the image bearing member to the recording material conveyed by the belt member;

a push-up member configured to push up, from an inner side of the belt member, the belt member at a position downstream of the transfer member in a recording-material conveying direction for forming a plurality of local projecting portions at the belt member in a width direction of the belt member;

a separation belt-stretching member around which the belt member is stretched, the separation belt-stretching member being disposed downstream of the push-up member in the recording-material conveying direction and configured to separate the recording material; and a recording material guide having a guide surface and disposed downstream of the separation belt-stretching member in the recording-material conveying direction, the recording material guide being configured to guide the recording material separated from the belt member with the guide surface;

wherein, when a space is divided into two regions by a tangent plane of a surface of the separation belt-stretching member and passing through a point where the belt member starts to come into contact with the separation belt-stretching member on a plane perpendicular to a width direction of the belt member and passing through a lowest point of a concave portion at the belt member between the local projecting portions formed by the push-up member, an upstream end of the guide surface of the recording material guide, in the recording-material conveying direction, is located in a region, where the separation belt-stretching member is located, of the two regions.

2. The image forming apparatus according to claim 1, wherein the upstream end of the guide surface of the recording material guide in the recording-material conveying direction is disposed above a center of rotation of the separation belt-stretching member in a vertical direction.

3. The image forming apparatus according to claim 1, wherein a downstream end of the guide surface of the recording material guide in the recording-material conveying direction, is located in a region, where the separation belt-stretching member is not located, of the two regions.

4. An image forming apparatus comprising:

an image bearing member configured to bear a toner image;

a movable belt member configured to convey a recording material;

a transfer member configured to electrostatically transfer the toner image formed on the image bearing member to the recording material conveyed by the belt member;

a push-up member configured to push up, from an inner side of the belt member, the belt member at a position downstream of the transfer member in a recording-material conveying direction for forming a plurality of local projecting portions in a width direction of the belt member;

a separation belt-stretching member around which the belt member is stretched, the separation belt-stretching member being disposed downstream of the push-up member in the recording-material conveying direction and configured to separate the recording material;

a recording material guide having a guide surface and disposed downstream of the separation belt-stretching member in the recording-material conveying direction, the recording material guide being configured to guide the recording material separated from the belt member with the guide surface and be able to move to different positions in a perpendicular direction that is perpendicular to the belt surface of the belt member, between the transfer portion and the separation belt-stretching member, that is not pushed up by the push-up member; and a control unit configured to control such that the recording material guide is located at a first position in the perpendicular direction when the recording material is separated from the belt member not by pushing up the belt surface with the push-up member but by using the separation belt-stretching member and such that the recording material guide is located at a second position lower than the first position in the perpendicular direction when the recording material is separated from the belt member by pushing up the belt member with the push-up member;

wherein, at the second position, an upstream end of the guide surface of the recording material guide in the recording-material conveying direction is located on the same side as the separation belt-stretching member with respect to an extension of the belt surface from the separation belt-stretching member to a recessed portion formed in the belt surface by the push-up member.

5. An image forming apparatus comprising:

an image bearing member configured to bear a toner image;

a movable belt member configured to convey a recording material;

a transfer member configured to electrostatically transfer the toner image formed on the image bearing member to the recording material conveyed by the belt member;

a push-up member configured to push up, from an inner side of the belt member, the belt member at a position downstream of the transfer member in a recording-material conveying direction for forming a plurality of local projecting portions in a width direction of the belt member, and configured to be able to move to a push-up position at which the push-up member pushes up the belt member and to a retracted position at which the push-up member does not push up the belt member;

a separation belt-stretching member around which the belt member is stretched, the separation belt-stretching member being disposed downstream of the push-up member in the recording-material conveying direction and configured to separate the recording material;

a recording material guide having a guide surface and disposed downstream of the separation belt-stretching member in the recording-material conveying direction, the recording material guide being configured to guide the recording material separated from the belt member with the guide surface and be able to move to different positions; and a control unit configured to control such that the recording material guide is located at a first position when the push-up member is located at the retracted position and such that the recording material guide is located at a second position when the push-up member is located at the push-up position.

6. The image forming apparatus according to claim 5, wherein the second position is lower than the first position in the vertical direction.

* * * * *